US005293933A

United States Patent [19]

Brisco

[11] Patent Number: 5,293,933

[45] Date of Patent: Mar. 15, 1994

[54] SWIVEL CEMENTING HEAD WITH MANIFOLD ASSEMBLY HAVING REMOTE CONTROL VALVES AND PLUG RELEASE PLUNGERS

[75] Inventor: David P. Brisco, Duncan, Okla.

[73] Assignee: Halliburton Company, Duncan, Okla.

[21] Appl. No.: 835,170

[22] Filed: Feb. 13, 1992

[51] Int. Cl.[5] ..... E21B 33/16

[52] U.S. Cl. ..... 166/70; 166/78

[58] Field of Search ..... 166/70, 78, 91, 153, 166/154, 155, 156

[56] References Cited

U.S. PATENT DOCUMENTS

| | | | |
|---|---|---|---|
| 2,029,598 | 2/1936 | Timbs et al. | 255/25 |
| 2,196,652 | 4/1940 | Baker | 166/1 |
| 2,599,039 | 6/1952 | Baker | 166/14 |
| 2,630,179 | 3/1953 | Brown | 166/14 |
| 2,647,582 | 8/1953 | Brown et al. | 166/1 |
| 3,076,509 | 2/1963 | Burns et al. | 166/70 |
| 3,322,197 | 5/1967 | Baker et al. | 166/75 |
| 3,616,850 | 11/1971 | Scott | 166/155 |
| 3,777,819 | 12/1973 | Delano | 166/285 |
| 3,779,270 | 12/1973 | Davis | 137/268 |
| 3,971,436 | 7/1976 | Lee | 166/70 |
| 4,234,216 | 11/1980 | Swanson et al. | 285/93 |
| 4,246,967 | 1/1981 | Harris | 166/291 |
| 4,290,482 | 9/1981 | Brisco | 166/70 |
| 4,302,033 | 11/1981 | Evans et al. | 285/14 |
| 4,427,065 | 1/1984 | Watson | 166/250 |
| 4,624,312 | 11/1986 | McMullin | 166/155 |
| 4,671,353 | 6/1987 | Daming | 166/70 |
| 4,722,389 | 2/1988 | Arnold | 166/70 |
| 4,962,812 | 10/1990 | Berzin | 166/187 |
| 4,995,457 | 2/1991 | Baldridge | 166/70 |
| 5,050,673 | 9/1991 | Baldridge | 166/70 |

OTHER PUBLICATIONS

Exhibit A—Drawing of a cement head apparatus sold by Nodeco (Undated but admitted to be prior art).

Exhibit B—Advertising brochure of Halliburton Company, Jul. 15, 1981.

Exhibit C—Two drawings of cementing head apparatus—Undated but admitted to be prior art.

Exhibit D—1982-83 Composite Catalog of Oilfield Equipment & Services, vol. 1, p. 1293.

Exhibit E—1982-83 Composite Catalog of Oilfield Equipment & Services, vol. 1, p. 18.

Exhibit F—Advertisement for rotary drilling swivel manufactured by Gray Tool Company (Undated but admitted to be prior art).

Exhibit G—Advertising brochure for Roto-Tek cementing system (Undated but admitted to be prior art).

Exhibit H—Advertisement for a cementing manifold sold by Lindsey Completion Systems (Undated but admitted to be prior art).

Exhibit I—Drawing of typical prior art casing swivel used for non-lift-through applications (Undated but admitted to be prior art).

Exhibit J—Photocopy of swivel previously used by assignee of present invention (Undated but admitted to be prior art).

Halliburton Services Sales & Service Catalog No. 43 (1985), pp. 2423-2426.

*Primary Examiner*—Terry Lee Melius

*Attorney, Agent, or Firm*—James R. Duzan; Neal R. Kennedy

[57] ABSTRACT

No swivel head with manifold assembly having remote control valves and plug release plungers. The assembly comprises a body connectable to a tool string, and a cementing manifold connectable to the cement source. The cementing manifold has remotely controllable cement control valves incorporated therein. The manifold is rotatably mounted on the body to provide continuous fluid communication between the manifold and body even when the body is rotating with respect to the manifold. The rotatable mounting is provided by a swivel connection comprising a mandrel extending from the body and a sleeve connected to the manifold. The swivel connection also provides continuous communication between a pressure line, extending from the sleeve to a pressure supply, and another pressure line, extending from the mandrel to a dart or ball releasing mechanism. This allows the releasing mechanism to be actuated even when the body is rotating with respect to the manifold and when the entire apparatus is being reciprocated. Preferably, another swivel connection is used which also provides continuous fluid communication between the manifold and body. A plug release indicator is also provided in one preferred embodiment.

18 Claims, 2 Drawing Sheets

SWIVEL CEMENTING HEAD WITH MANIFOLD ASSEMBLY HAVING REMOTE CONTROL VALVES AND PLUG RELEASE PLUNGERS

BACKGROUND OF THE INVENTION

1. The present invention relates to cementing head apparatus, and more particularly, to a cementing head having a plug container body rotatable with respect to a cementing manifold while maintaining fluid communication therebetween and having remote control valves in the manifold assembly and remote control plug or ball release plungers on the body. The rotatable mounting allows simultaneous rotation from above and reciprocation of the cementing head while pumping to improve cement flow through the apparatus drill string or casing attached thereto.

2. Description Of The Prior Art

One type of cementing apparatus which is commonly used in the completion of offshore wells is that known as a subsurface release cementing system. In a subsurface release cementing system, cement plugs are hung off in the upper end of the casing near the ocean floor. Devices such as balls and darts are released from a plug container or cementing head located at the floating drilling rig. The balls or darts fall downwardly through the drill pipe to engage the cementing plugs hung off in the casing head and to cause those cementing plugs to be released so that they will flow downwardly through the casing with the cement.

One such system is shown in U.S. Pat, No. 4,624,312 to McMullin, assigned to the assignee of the present invention. These types of cementing plug methods and equipment are also described in Halliburton Sales & Service Catalog No. 43 (1985), pages 2423–2426. In this apparatus there is a cementing manifold attached to the plug container above and below the top releasing plug and plug release.

It is known to construct the cementing head in what is referred to as a "lift-through" design, wherein the entire weight of the drill pipe string hung below the drilling platform is supported through or lifted through the structure of the cementing head. This allows the plug container and drill pipe string to be reciprocated during cementing operations to help remove mud from the well annulus and provide an even distribution of cement in the annulus. This reciprocation is accomplished by attaching the rig elevators to the apparatus so that the cementing head and drill string may be reciprocated by the elevators.

While reciprocation of the apparatus during cementing has the advantages mentioned, rotation of the casing also helps provide better cement flow. A problem with the prior art cementing head as described above is that the cementing manifold is rigidly attached to the plug container body so that rotation of the body is prevented because of the cementing lines connected to the cementing manifold. Thus, the only way to rotate the casing is to disconnect the cementing line prior to rotation. In other words, rotation cannot occur while cement is actually being pumped.

Lift-through cementing heads have been developed with swivel connections below the plug container body in the drill pipe string therebelow. One such apparatus is disclosed in U.S. patent application Ser. No. 07/444,657, (U.S. Pat. No. 4,995,457), assigned to the assignee of the present invention. By engaging the drill pipe string below the swivel by the slips on the rig floor, rotation is possible without disconnecting the cementing lines from the cementing manifold. Thus, cement can be pumped through the apparatus and down the drill pipe string while the drill pipe string is rotated. However, the apparatus may not be reciprocated and rotated at the same time since the rotation is provided by the slips on the rig floor below the cementing head.

Accordingly, there is a need for a cementing head which may be both reciprocated and rotated simultaneously with the pumping of cement through the apparatus down the drill pipe string. The present invention meets this need by providing a cementing head with a plug container body which may be rotated with respect to the cementing manifold while maintaining fluid communication therebetween so that cement may be pumped during rotation. With the present invention, rotation may be provided by top drive units above the apparatus which may be rotated substantially simultaneously with reciprocation by the elevators. Thus, the cementing head of the present apparatus may be reciprocated and rotated during a cement pumping operation.

There is also a need for a cementing head assembly in which the cement control valves in the cement manifold may be actuated without stopping reciprocation of the apparatus so the process is carried out substantially uninterrupted. Further, there is a need for a cementing head in which any plug release plungers may be operated without stopping reciprocation and/or rotation of the assembly. The present invention meets this need by providing remotely operated cement control valves and plug release plungers which may be actuated without stopping reciprocation and rotation. This is accomplished by the use of remote control lines connected to the valves and by indirect connection of remote control lines to the plug release plungers through a portion of a rotatable mounting means connecting the cementing manifold to the plug container body.

SUMMARY OF THE INVENTION

The swivel cementing head with manifold assembly having remote control valves and plug release plungers of the present invention is adapted for cementing operations performed in the completion of wells. One particular application, but not by way of limitation, is the completion of offshore wells using a subsurface release cementing system.

The cementing head apparatus comprises a body connectable to a tool string, a cementing manifold connectable to a cement source, mounting means for rotatably mounting the manifold on the body and providing continuous fluid communication between the manifold and body, and remote control valve means in the cementing manifold for controlling fluid flow from the manifold to the body. The apparatus may further comprise plug means positionable in the body for moving downwardly through the tool string for releasing a cement plug in the casing, pressure actuated releasing means for releasing the plug means so that the plug means may be pumped down the tool string, and connecting means for connecting the releasing means to a pressure supply for providing continuous communication between the pressure supply and the releasing means regardless of the relative rotation between the body and the cementing manifold.

In the preferred embodiment the connecting means comprises a swivel connection between the body and manifold, and the mounting means also may be characterized by at least a portion of the swivel connection. The apparatus may comprise another swivel connection forming a part of the mounting means on an opposite side of the releasing means from the first mentioned swivel connection.

One embodiment of the swivel connection between the body and manifold comprises a mandrel extending from the body and defining a pressure passageway therethrough, and a sleeve rotatably disposed around the mandrel and defining a hole therein in fluid communication with the passageway. The apparatus further comprises a pressure line interconnecting the passageway and the releasing means, and another pressure line in communication with the hole and connectable to the pressure supply. The mandrel may be integrally formed with the body or separable therefrom.. A plurality of sets of pressure lines, passageways and holes may be used depending upon the number of releasing means required for any particular operation.

A sealing means may be provided between the mandrel and sleeve, and bearing means may be provided for rotatably mounting the sleeve on the mandrel.

In one preferred embodiment, the mandrel and sleeve define a groove therein adjacent to an end of the passageway and an end of the transverse hole so that the passageway and hole are always in communication regardless of the relative rotational position between the mandrel and sleeve.

Stated in another way, the cementing head apparatus of the present invention comprises a body assembly connectable to a tool string and adapted for receiving a plug therein, releasing means engaged with the body assembly for releasing the plug received in the body assembly so that the plug may be pumped down the tool string, a pressure line interconnecting a pressure passageway defined in the body assembly with the releasing means, a first sleeve pivotally engaged with a first mandrel portion of the body assembly and in communication therewith, and a second sleeve pivotally engaged with a second mandrel portion of the body assembly and in communication therewith. The first sleeve defines a hole therein in communication with the pressure passageway, and another pressure line is provided in communication with the hole and is connectable to a pressure supply. A cementing manifold is connected to the first and second sleeves and is in fluid communication therewith such that the body is rotatable with respect to the manifold while maintaining communication therebetween and while further maintaining communication between the pressure lines.

The first sleeve and first mandrel portion define an annular first fluid channel therebetween, and the second sleeve and second mandrel portion define an annular second fluid channel therebetween. Sealing means may be provided for sealing between the body and the first and second sleeves on opposite sides of each of the first and second fluid channels. At least one of the first mandrel portion and the first sleeve may define an annular channel therein which is in communication with the pressure passageway and the hole. Another sealing means may be provided for sealing between the first mandrel portion and the first sleeve on opposite sides of the annular channel.

In one embodiment of the cementing head apparatus, the passageway is one of a plurality of passageways, each passageway having a pressure line connected thereto, and the hole is one of a plurality of holes, each hole being in communication with one of the passageways and having another pressure line connected thereto.

An important object of the present invention is to provide a cementing head in which cement control valves and/or plug release plungers may be operated remotely while the cementing head is reciprocated and rotated.

Another object of the invention is to provide a cementing head which may be reciprocated and rotated while pumping cement therethrough.

An additional object of the invention is to provide a cementing head with a plug container body which is rotatable with respect to a cementing manifold while maintaining fluid communication therebetween and while maintaining a connection between remote control lines to plug release plungers on the body.

A further object of the invention is to provide a cementing head with a swivel connection which maintains fluid communication, during rotation of the body, between remote control lines and a plug release mechanism mounted on the body.

Additional objects and advantages of the invention will become apparent as the following detailed description of the preferred embodiment is read in conjunction with the drawings which illustrate such embodiment.

DESCRIPTION OF THE PREFERRED EMBODIMENT

Figure 1A:
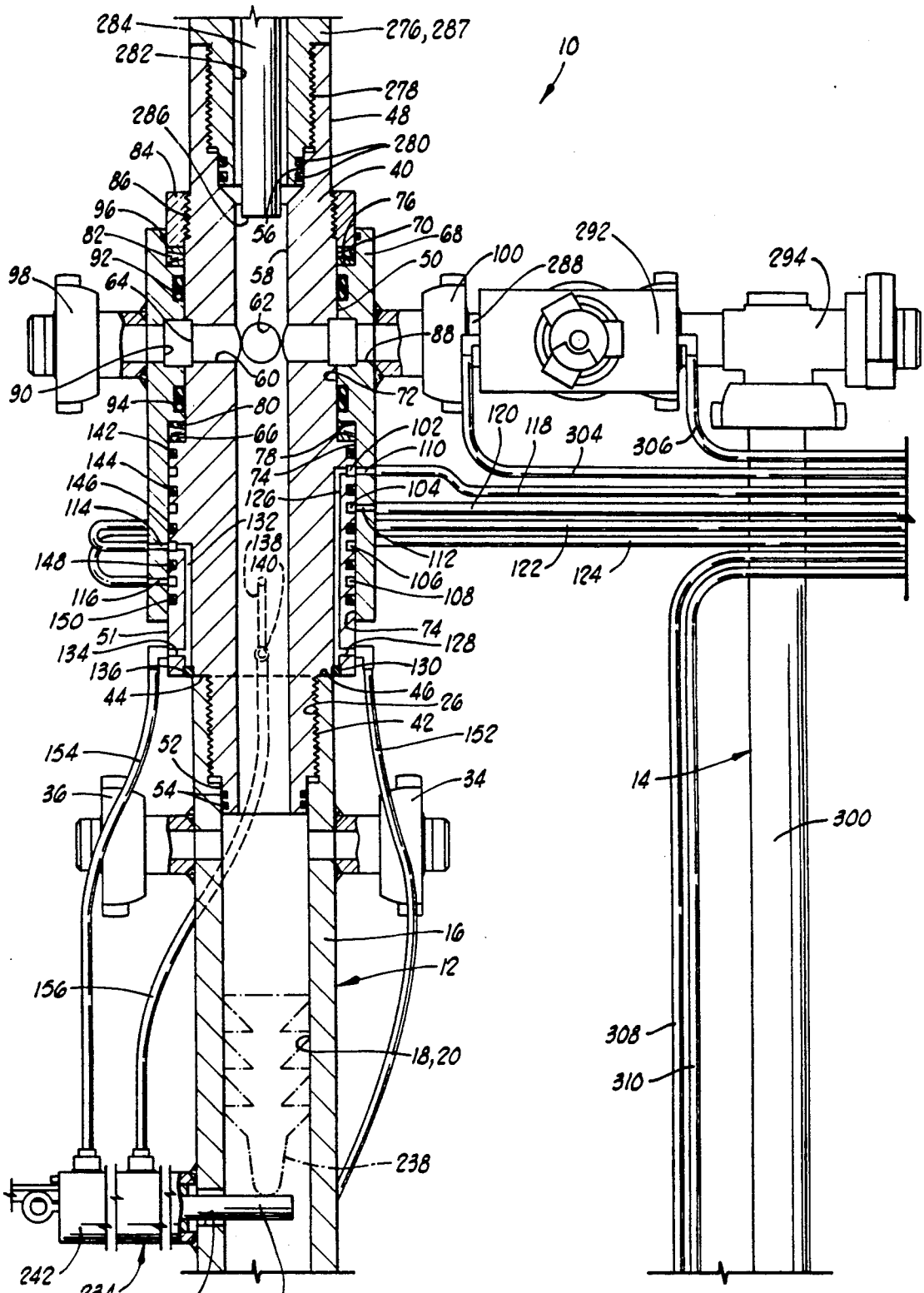
FIGS. 1A and 1B show the swivel cementing head with manifold assembly and remote control of the present invention with many of the components in cross section and the cementing manifold in elevation.
Figure 1B:
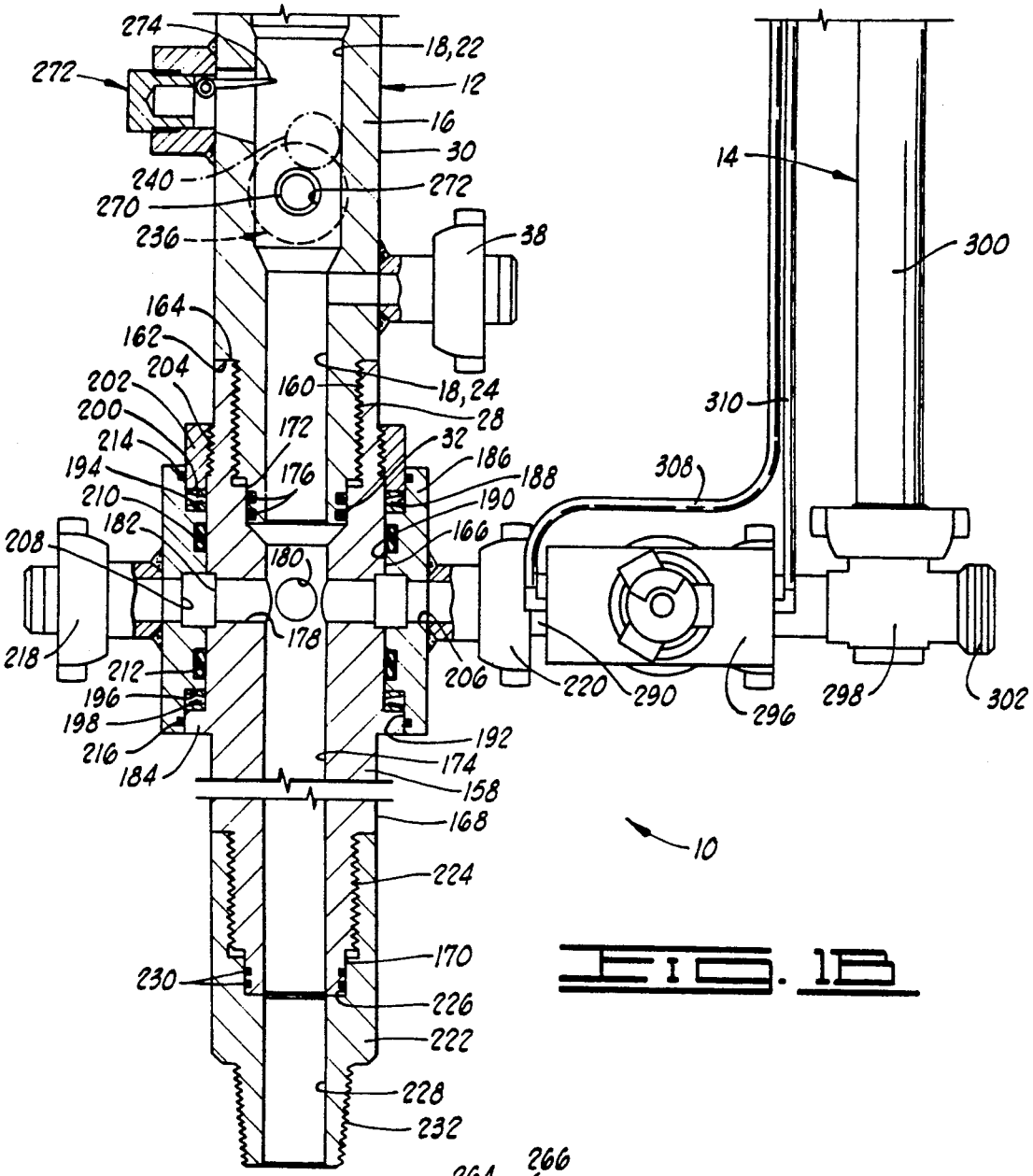

Referring now to the drawings, and more particularly to FIGS. 1A and 1B, the swivel cementing head with manifold assembly and remote control of the present invention is shown and generally designated by the numeral 10. Generally, cementing head 10 comprises a body assembly 12 with a manifold assembly 14 attached thereto while allowing relative rotation therebetween as will be further described herein.

A major component of body assembly 10 is a plug container body 16 which defines a central opening 18 therethrough. Central opening 18 is formed by a first bore 20 in body 16, a slightly smaller second bore 22, and an even smaller third bore 24. Above first bore 20 at the upper end of body 16 is an internally threaded surface 26, and at the lower end of body 16 is an externally threaded surface 28. Container body 16 has a first outside diameter 30 above externally threaded surface 28 and a smaller second outside diameter 32 below externally threaded surface 28.

As illustrated, container body 16 is of a kind known in the art, such as that used in the apparatus of U.S. patent application Ser. No. 07/444,657, and is therefore illustrated with a plurality of hammer unions 34, 36 and 38 which are attached to first outside diameter 30 of container body 16 by any means known in the art, such as welding. As will be further explained herein, these particular hammer unions 34, 36 and 38 are not used in the present invention, and accordingly, hammer unions 34, 36 and 38 are simply plugged off in any known manner. Thus, it will be seen by those skilled in the art that rather than using the illustrated prior art container body 16, a new, slightly different container body 16 could be utilized without any hammer unions 34, 36 and 38 at all.

Referring to FIG. 1A, an upper swivel mandrel 40 is attached to the upper end of container body 16 by the engagement of externally threaded surface 42 on upper swivel mandrel 40 with internally threaded surface 26 in container body 16. Thus, it may be said that a threaded connection 42, 26 is formed. When this threaded connection 42, 26 is completed, a downwardly facing shoulder 44 on upper swivel mandrel 40 preferably engages upper end 46 of container body 16.

Upper swivel mandrel 40 has a first outside diameter 48, a second outside diameter 50, a third outside diameter 51, and a fourth outside diameter 52. Fourth outside diameter 52 on upper swivel mandrel 40 extends into first bore 20 in container body 16 A sealing means, such as O-rings 54, provides sealing engagement between upper swivel mandrel 40 and container body 16.

Upper swivel mandrel 40 defines a first bore 56 and a second bore 58 therein which define a longitudinally extending central opening therethrough. It will be seen that second bore 58 in upper swivel mandrel 40 is in communication with central opening 18 in container body 16.

A transverse hole 60 extends through upper swivel mandrel 40 and intersects, and thus is in communication with, second bore 58. Upper swivel mandrel 40 may also include another transverse hole 62 which is aligned longitudinally with transverse hole 60. In the embodiment shown, holes 60 and 62 are perpendicular to one another, but this is not required. An annular undercut or groove 64 is formed around the outer ends of transverse holes 60 and 62. The width of undercut 64 is preferably larger than the diameter of holes 60 and 62. Thus, holes 60 and 62 do not extend to second outside diameter 50 of upper swivel mandrel 40.

An upwardly facing annular shoulder 66 extends between second outside diameter 50 and third outside diameter 51 of upper swivel mandrel 40.

Rotatably disposed around upper swivel mandrel 40 is an upper swivel sleeve 68. Upper swivel sleeve 68 defines a first bore 70 therein, a second bore 72 which is in close relationship with second outside diameter 50 on upper swivel mandrel 40, and a third bore 74 which is substantially the same size as first bore 70 and in close relationship with third outside diameter 51 on upper swivel mandrel 40. An upwardly facing annular shoulder 76 extends between first bore 70 and second bore 72, and a similar downwardly facing annular shoulder 78 extends between second bore 72 and third bore 74.

A thrust bearing 80 is disposed in the annular gap defined between third bore 74 in upper swivel sleeve 68 and second outside diameter 50 on upper swivel mandrel 40. It will be seen that thrust bearing 80 is thus longitudinally positioned between shoulder 66 on upper swivel mandrel 40 and shoulder 78 on upper swivel sleeve 68.

A similar or identical thrust bearing 82 is disposed in the annular gap defined between first bore 70 in upper swivel sleeve 68 and second outside diameter 50 on upper swivel mandrel 40. A nut 84 is attached to upper swivel mandrel 40 at threaded connection 86 and clamps thrust bearing 82 against shoulder 76 on upper swivel sleeve 68. Those skilled in the art will also see that the other thrust bearing 80 is also clamped in place, and upper swivel sleeve 68 is longitudinally locked in position with respect to upper swivel mandrel 40. However, upper swivel mandrel 40 is free to rotate within upper swivel sleeve 68 on thrust bearings 80 and 82. Thrust bearings 80 and 82 are preferably tapered roller thrust bearings, but many known bearing configurations could be used.

Upper swivel sleeve 68 defines a transverse hole 88 therethrough which is longitudinally aligned with transverse holes 60 and 62 in upper swivel mandrel 40. An annular undercut or groove 90 is defined in upper swivel sleeve 68 and is aligned and in communication with undercut 64 in upper swivel mandrel 40. Undercut 90 is preferably wider than the diameter of transverse hole 88 so that transverse hole 88 does not actually extend to second bore 72 in upper swivel sleeve 68. It will be seen that undercuts 64 and 90 define an annular channel between upper swivel sleeve 68 and upper swivel mandrel 40, and it will be further seen that transverse hole 88 is therefore always in communication with transverse holes 60 and 62. Thus, hole 88 is also in fluid communication with second bore 58 in upper swivel mandrel 40, regardless of the rotated position of upper swivel mandrel 40 with respect to upper swivel sleeve 68.

A sealing means, such as a pair of packing rings 92 and 94, provides sealing engagement between upper swivel sleeve 68 and upper swivel mandrel 40 on opposite sides of the annular channel formed by undercuts 64 and 90. Another sealing means, such as O-ring 96, provides sealing engagement between upper swivel mandrel 68 and nut 84.

A pair of hammer unions 98 and 100 are attached to the outside of upper swivel sleeve 68 by any means known in the art, such as by welding. Hammer unions 98 and 100 are aligned with opposite ends of transverse hole 88. Hammer unions 98 and 100 are of a kind known in the art and are similar or identical to hammer unions 34, 36 and 38, previously described.

A plurality of outwardly facing undercuts or grooves 102, 104, 106 and 108 are defined in third outside diameter 51 of upper swivel mandrel 40. These undercuts are aligned and in communication with a plurality of transverse holes 110, 112, 114, and 116, respectively, defined in upper swivel sleeve 68. The location of holes 110, 112, 114 and 116 angularly around upper swivel sleeve 68 is not critical and is not intended to be limited to the orientation shown in FIG. 1A. The only requirement is that each transverse hole be in communication with a corresponding undercut.

A series of pressure lines 118, 120, 122 and 124 are connected to holes 110, 112, 114, and 116, respectively. The opposite ends of pressure lines 118, 120, 122 and 124 are connected to a pressure supply (not shown), such as a pneumatic or hydraulic pressure source. This pressure supply is used to actuate the remote control of cementing head 10 in a manner hereinafter described.

A passageway 126 interconnects undercut 102 with a transverse hole 128 in upper swivel mandrel 40 below upper swivel sleeve 68. A lower end of the longitudinal portion of passageway 126 is closed by a plug 130. A similar passageway 132 interconnects undercut 106 with a transverse hole 134. The lowermost end of the longitudinal portion of passageway 132 is closed by a plug 136. An additional passageway 138 interconnects undercut 108 and a transverse hole 140. A further passageway 141 (not shown) interconnects undercut 104 with another transverse hole 143 (not shown) angularly spaced from holes 128, 134 and 140.

A sealing means, such as a plurality of O-rings 142, 144, 146, 148 and 150, provide sealing engagement between third outside diameter 51 of upper swivel mandrel 40 and third bore 74 in upper swivel sleeve 68 below thrust bearing 80. It will be seen by those skilled in the art that O-rings 142 and 144 seal on opposite sides of undercut 102, O-rings 144 and 146 seal on opposite sides of undercut 104, O-rings 146 and 148 seal on opposite sides of undercut 106, and O-rings 148 and 150 seal on opposite sides of undercut 108.

One end of a pressure line 152 is connected to hole 128, another pressure line 154 is connected to hole 134, an additional pressure line 156 is connected to hole 140, and still another pressure line 157 (not shown) is connected to unshown hole 143 in upper swivel mandrel 40.

Undercut 102 in upper swivel mandrel 40 insures that hole 110 in upper swivel mandrel 68 is always in communication with passageway 126 regardless of the relative rotational position of upper swivel mandrel 40 with respect to upper swivel sleeve 68. Thus, it will be seen by those skilled in the art that pressure line 118 is always in communication with pressure line 152. Similarly, pressure line 120 is always in communication with unshown pressure line 157 connected to upper swivel mandrel 40. Further, pressure line 122 is always in communication with pressure line 154, and pressure line 124 is always in communication with pressure line 156. As will be further discussed herein, it is clear that the unshown pressure supply thus will always supply pressure to pressure lines 152, 154, 156 and unshown pressure line 157, even when upper swivel mandrel 40 is rotating within upper swivel sleeve 68.

Referring now to FIG. 1B, a lower swivel mandrel 158 is attached to the lower end of container body 16 by the engagement of internally threaded surface 160 in lower swivel mandrel 158 by externally threaded surface 28 on container body 16. Thus, it may be said that a threaded connection 160, 28 is formed. When this threaded connection 160, 28 is completed, a downwardly facing shoulder 162 on container body 16 preferably engages upper end 164 of lower swivel mandrel 158.

Lower swivel mandrel 158 has a first outside diameter 166, a second outside diameter 168, and a third outside diameter 170.

Lower swivel mandrel 158 has a first bore 172 disposed longitudinally therein and a second bore 174 longitudinally therethrough which define a longitudinally extending central opening. It will be seen that second bore 174 in lower swivel mandrel 158 is in communication with central opening 18 in container body 16.

Second outside diameter 32 of container body 16 extends into first bore 172 in lower swivel mandrel 158. A sealing means, such as a pair of O-rings 176, provides sealing engagement between container body 16 and lower swivel mandrel 158.

A transverse hole 178 extends through lower swivel mandrel 158 and intersects, and is thus in communication with, second bore 174. Lower swivel mandrel 158 may also include another transverse hole 180 which is aligned longitudinally with transverse hole 178 In the embodiment shown, holes 178 and 180 are perpendicular to one another, but this is not required. An annular undercut or groove 182 is formed around the outer ends of transverse holes 178 and 180. The width of undercut 182 is preferably larger than the diameter of holes 178 and 180. Thus, holes 178 and 180 do not extend to second outside diameter 166 of lower swivel mandrel 158.

An annular flange 184 extends outwardly on lower swivel mandrel 158 below second outside diameter 166.

Rotatably disposed around lower swivel mandrel 158 is a lower swivel sleeve 186. Lower swivel sleeve 186 defines a first bore 188 therein, a second bore 190 which is in close relationship with second outside diameter 166 on lower swivel mandrel 158, and a third bore 192 which is substantially the same size as first bore 188. An upwardly facing annular shoulder 194 extends between first bore 188 and second bore 190, and a similar downwardly facing shoulder 196 extends between second bore 190 and third bore 192.

A thrust bearing 198 is disposed in the annular gap defined between third bore 192 in lower swivel sleeve 186 and first outside diameter 166 on lower swivel mandrel 158. It will be seen that thrust bearing 198 is thus longitudinally positioned between flange 184 on lower swivel mandrel 158 and shoulder 196 on lower swivel sleeve 186.

A similar or identical thrust bearing 200 is disposed in the annular gap defined between first bore 188 in lower swivel sleeve 186 and first outside diameter 166 on lower swivel mandrel 158. A nut 202 is attached to lower swivel mandrel 158 at threaded connection 204 and clamps thrust bearing 200 against shoulder 194 on lower swivel sleeve 186. Those skilled in the art will also see that the other thrust bearing 198 is clamped in place, and lower swivel sleeve 186 is longitudinally locked into position with respect to lower swivel mandrel 158. However, lower swivel mandrel 158 is free to rotate within lower swivel sleeve 186 on thrust bearings 198 and 200. Thrust bearings 198 and 200 are preferably identical to thrust bearings 80 and 82 previously described.

Lower swivel sleeve 186 defines a transverse hole 206 therethrough which is longitudinally aligned with transverse holes 178 and 180 in lower swivel mandrel 158. An annular undercut or groove 208 is defined in lower swivel sleeve 186 and is aligned and in communication with undercut 182 in lower swivel mandrel 158. Undercut 208 is preferably wider than the diameter of transverse hole 206 so that transverse hole 206 does not actually extend to second bore 190 in lower swivel sleeve 186. It will be seen that undercuts 182 and 208 define an annular channel between lower swivel sleeve 186 and lower swivel mandrel 158, and it will be further seen that transverse hole 206 is therefore always in fluid communication with transverse holes 178 and 180. Thus, hole 206 is also in fluid communication with second bore 174 in lower swivel mandrel 158, regardless of the rotated position of lower swivel mandrel 158 with respect to lower swivel sleeve 186.

A sealing means, such as a pair of packing rings 210 and 212, provides sealing engagement between lower swivel 186 and lower swivel mandrel 158 on opposite sides of the annular channel formed by undercuts 182 and 208 Another sealing means, such as O-ring 214, provides sealing engagement between lower swivel mandrel 158 and nut 202. A further sealing means, such as O-ring 216, provides sealing engagement between lower swivel sleeve 186 and flange 184 on lower swivel mandrel 158 below thrust bearing 198.

A pair of hammer unions 218 and 220 are attached to the outside of lower swivel sleeve 186 by any means known in the art, such as by welding. Hammer unions 218 and 220 are aligned with opposite ends of transverse hole 206. Hammer unions 218 and 220 are of a kind known in the art and are substantially identical to hammer unions 34, 36, 38, 98 and 100, previously described.

The lower end of lower swivel mandrel 158 is attached to a lower adapter 222 at threaded connection 224. Lower adapter 222 is of a kind known in the art and has a first bore 226 therein and a second bore 228 therethrough. Third outside diameter 170 of lower swivel mandrel 158 extends into first bore 226 in lower adapter 222. A sealing means, such as a pair of O-rings 230, provides sealing engagement between lower swivel mandrel 158 and lower adapter 222. It will be seen that second bore 228 in lower adapter 222 is in communication with second bore 174 in lower swivel mandrel 158.

Lower adapter 222 has an externally threaded surface 232, which is preferably a standard tapered threaded pin connection, thereon for connection to a string of drill pipe (not shown) suspended therefrom in a manner known in the art. Lower adapter 222 may be said to be a portion of body assembly 12.

Cementing head apparatus 10 includes an upper releasing assembly or mechanism 234 (see FIG. 1A) and a lower releasing assembly or mechanism 236 (see FIG. 1B) associated with an elongated releasing plug or dart 238 and a spherical releasing ball 240, respectively. Dart 238, ball 240 and similar items may be collectively or individually referred to as plug means for moving downwardly through the tool string. Upper and lower releasing mechanisms 234 and 236 are preferably angularly spaced about the longitudinal axis of cementing head apparatus 10 at an angle of about 90°. The details of construction of upper and lower releasing mechanisms 234 and 236 are substantially identical. Those details will be described with regard to upper releasing mechanism 234.

Figure 2:
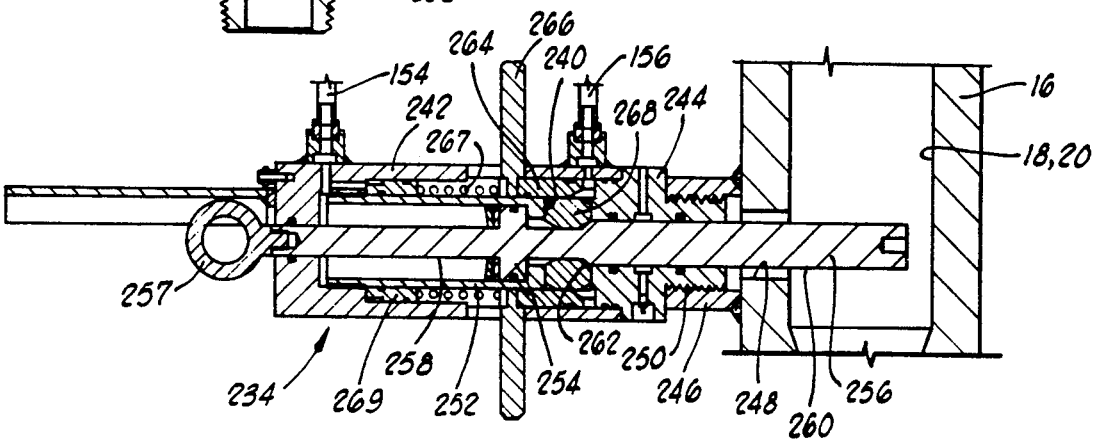
FIG. 2 is a cross-sectional view of a remote control plug release mounted on the body of the cementing head.

Referring to FIG. 2, upper releasing mechanism 234 includes a housing 242 which is connected to a body 244 defining a plurality of windows 245 therein. Container body 16 has a collar 246 extending therefrom which is substantially coaxial with a transverse hole 248 through the container body. Body 244 of upper releasing mechanism 234 is engaged with collar 248 at threaded connection 250.

Body 244 also has an elongated cylinder portion 252. A piston portion 254 of a release plunger 256 is slidably disposed in cylinder portion 252. Plunger 256 extends through hole 248 into container body 16 when in a first position shown in FIG. 2 in which dart 238 is prevented from moving downwardly. As will be further discussed herein, plunger 256 has a second position in which it is completely withdrawn from first bore 20 of container body 16 for release of dart 238.

A manual Operating ring 257 is attached to the outer end of plunger 256. Ring 257 is disposed externally from housing 242.

Plunger 256 has a first outside diameter 258 and a larger second outside diameter 260. A chamfer 262 extends between first outside diameter 258 and second outside diameter 260.

A sliding sleeve 264 is disposed between cylinder portion 252 of body 244 and housing 242. A handle 266 is attached to sleeve 264. A spring 267 biases sleeve 264 toward the right as shown in FIG. 2.

A locking dog 268 is disposed in each window 240 in body 244. In the initial position shown in FIG. 2, locking dogs 268 are forced inwardly by sleeve 264 against first outside diameter 258 of plunger 256 adjacent to chamfered 262.

A return piston 269 is positioned on the opposite end of spring 267 from sleeve 264.

Upper releasing mechanism 234 is a pneumatically or hydraulically actuated device, and the other ends of pressure lines 154 and 156 are connected to body portion 242 on opposite sides of piston 254. By varying the pressure in pressure lines 154 and 156, as further described herein, sleeve 264 may be moved to the left as shown in FIG. 2. When this occurs, locking dogs 268 are no longer retained. Pressure acting on piston portion 254 of plunger 256 will move the plunger to the left, deflecting locking dogs 268 radially outwardly as second outside diameter 260 passes in side the locking dogs. Thus, plunger 256 is moved to its second position in which it no longer extends into central opening 18 in container body 16 Manual actuation of upper releasing mechanism 234 is made possible by release handle 266. That is, moving handle 266 to the left also moves sleeve 264 to the left, releasing locking dogs 268. Plunger 256 may then be moved to the left by pulling on ring 257.

To return plunger 256 to its original position, pressure in lines 154 and 156 is reversed. This pressure acts on piston portion 254 of plunger 256 causing it to move to the right as shown in FIG. 2. Pressure acting on return piston 269 returns sleeve 264 back to its original position. As sleeve 264 engages locking dogs 268, it forces the locking dogs radially back inwardly so that the apparatus is again in the configuration shown in FIG. 2.

As indicated, lower releasing mechanism 236 (see FIG. 1B) is substantially identical to upper releasing mechanism 234 and includes a plunger 270 which extends through a transverse hole 272 into second bore 22 in container body 16 in much the same way as plunger 256 extends through hole 248 into first bore 20 in container body 16. Pressure is supplied to lower releasing mechanism 236 for actuation of plunger 270 by connection of pressure line 152 and unshown pressure line 157.

Ball 240 is dimensioned so that when plunger 270 is extended into second bore 22 in container body 16, ball 240 will be located above and will engage plunger 270 of lower releasing mechanism 236. Similarly, dart 238 is sized and positioned such that it will initially engage plunger 256 of upper releasing mechanism 234. When plunger 270 of lower releasing mechanism 236 is retracted, ball 240 is permitted to drop through cementing head apparatus 10. When plunger 256 of upper releasing mechanism 234 is retracted, dart 238 is permitted to drop through cementing head apparatus 10. Dart 238 and ball 240 themselves are of a kind known in the art, and the release of such a dart and ball is also known.

As shown in FIG. 1B, an indicator mechanism 272 is mounted on container body 16 between upper and lower releasing mechanisms 234 and 236. Indicator mechanism 272 has a trip lever 274 extending into second bore 22 of container body 16. Trip lever 274 will trip when dart 238 passes downwardly through container body 16, thereby providing an indication that the dart has been released.

Referring again to FIG. 1A, a lifting sub 276 may be attached to upper swivel mandrel 40 at threaded connection 278. A sealing means, such as a pair of O-rings 280, provides sealing engagement between lifting sub 276 and first bore 56 in upper swivel mandrel 40. Lifting sub 276 is adapted for engagement by a conventional pair of elevator bales (not shown) of a drilling rig in order to raise lifting sub 276 and the various apparatus components suspended therefrom. Lifting sub 276 itself is of a kind known in the art.

Lifting sub 276 has a loading bore 282 defined therethrough which is in communication with second bore 58 in upper swivel mandrel 40. Loading bore 282 is approximately the same size as second bore 58 in upper swivel mandrel 40, and both of these bores have a diameter greater than the diameter of releasing ball 240 so that the releasing ball can pass downwardly therethrough. Releasing dart 238 has large diameter wiper cups thereon which are very flexible and can be compressed sufficiently so that dart 238 can also be pushed downwardly through loading bore 282 in lifting sub 276 and second bore 58 in upper swivel body 40. A rod 284 extends into loading bore 282 and serves two purposes. First, rod 284 may be utilized to push releasing dart 238 through loading bore 282. Second, a lower end 286 of rod 284 prevents dart 238 from floating upwardly far enough to cause any operational difficulties during the cementing job. The loading of releasing dart 238 through lifting sub 276 in the manner described is not necessary because releasing dart 238 may be positioned in container body 16 prior to installation of upper swivel mandrel 40.

As will be further described herein, lifting sub 276 may be removed from upper swivel mandrel 40 prior to operation so that a top drive unit (not shown) of the drilling rig may be used. An upper adapter 287 is connected to upper swivel mandrel 40 at threaded connection 278 instead of lifting sub 276. Upper adapter 287 is of a kind known in the art and has a bore therethrough which is substantially the same as bore 282 in lifting sub 276. With adapter 287, rod 284 is not used.

The upper end (not shown) of upper adapter 287 is adapted in a manner known in the art for engagement by a top drive unit (not shown) of the drilling rig. The top drive unit may then be used to rotate the apparatus during the cementing job as will be hereinafter described.

Manifold assembly 14 is connected to upper swivel sleeve 68 through hammer union 100 and lower swivel sleeve 186 through hammer union 220. Manifold assembly 14 includes an upper cementing line 288 which is engaged by hammer union 100 in a manner known in the art. Similarly, manifold assembly 14 also includes a lower cementing line 290 engaged by hammer union 220.

Manifold assembly 14 further includes an upper cement control valve 292 connected on one side to upper cementing line 288 and on the other side to upper tee 294. Similarly, a lower cement control valve 296 is connected to lower cementing line 290 on one side and to lower tee 298 on the other side. Upper tee 294 and lower tee 298 are interconnected by vertical conduit 300. Lower tee 298 includes an inlet 302 through which cement and other fluids may be provided to manifold assembly 14 and thus to entire cementing apparatus 10.

Upper valve 292 is a pneumatically or hydraulically actuated device, and control pressure is supplied thereto through pressure lines 304 and 306 which are connected to the unshown pressure supply. Lower valve 296 is substantially identical to upper valve 292, and control pressure is supplied thereto through pressure lines 308 and 310 which are connected to the pressure supply.

Upper and lower valves 292 and 296 are used to control the flow of cement and other fluids so that they can be selectively diverted to the lower end of container body 16 prior to the release of dart 238, and then to the upper end of container body 16 after release of the dart.

Operation Of The Invention

Cementing head apparatus 10 has been particularly designed for use in offshore operations where very heavy loads must be suspended from the cementing head apparatus and where it is desirable to rotate the drill pipe and/or casing suspended below lower adapter 222 during cementing. Cementing head apparatus is also designed for remote control operation so that the operator does not have to manually operate the valves in manifold assembly 14 or manually release ball 240 and/or dart 238.

As previously mentioned, cementing head apparatus 10 may be supported with elevator bales received about lifting sub 276. Alternatively as previously mentioned, a top drive unit of the drilling rig may be engaged with upper adapter 287. Drill pipe is connected to lower adapter 222 at threaded surface 232, and the weight of the drill pipe and/or liner located therebelow is carried in tension by cementing head apparatus 10.

Pressure is appropriately supplied through pressure lines 304 and 306 to close upper valve 292 and through pressure lines 308 and 310 to open lower valve 296. Cement is then pumped into cementing head apparatus 10 through lower cementing line 290 and through lower swivel sleeve 186 and lower swivel mandrel 158.

Pressure is then appropriately supplied to pressure lines 118 and 120, and because of the continuous communication provided by the unique arrangement of upper swivel sleeve 68 and upper swivel mandrel 40, this pressure is thus applied through pressure line 152 and unshown pressure line 157 to actuate lower releasing mechanism 236 to withdraw plunger 270 from second bore 22 in container body 16 to its second position. Thus, releasing ball 240 is released so that the ball flows downwardly near the lower end of the cement slug.

As will be understood by those skilled in the art, releasing ball 240 will seat in a bottom cementing plug (not shown) typically hung off in the casing adjacent to the ocean floor. Once ball 240 seats, the bottom cementing plug will release and flow downwardly to define the lower phase of the cementing slug flowing down into the casing.

When sufficient cement has been pumped into the well to perform the cementing job, appropriate pressure is supplied through pressure lines 122 and 124, and because of the upper swivel connection, thus supplied to pressure lines 154 and 156 to actuate upper releasing mechanism 234 as previously discussed so that plunger 256 is withdrawn from first bore 20 in container body 16 to its second position. This releases dart 238. The pressure in pressure lines 304, 306, 308 and 310 is then reversed so that upper valve 292 is opened and lower valve 296 is closed. Fluid is thus diverted through upper cementing line 288 and thus through upper swivel sleeve 68 and upper swivel mandrel 40 so that dart 238 flows downwardly. Dart 238 will subsequently seat in the top cementing plug (not shown), causing the top cementing plug to release and flow downwardly with the cement slug adjacent to the upper extremity of the cement slug.

During this entire cementing operation, body assembly 12 which includes upper adapter 287, upper swivel mandrel 40, container body 16, lower swivel mandrel 158 and lower adapter 222 may be simultaneously reciprocated and rotated to insure a smooth flow of cement down through the drill pipe and casing. Manifold assembly 14 does not have to be disconnected from its supply line or from body assembly 12 during this reciprocation and rotation because of the upper and lower swivel connections. That is, as body assembly 12 is rotated, upper swivel mandrel 40 rotates within upper swivel sleeve 68, and lower swivel mandrel 158 rotates within lower swivel sleeve 186. The annular channels defined between undercuts 64 and 90 in the upper swivel assembly and between undercuts 182 and 208 in the lower swivel assembly insure that there is a constant flow path from manifold assembly 14 into the central opening through body assembly 12.

Further, the constant communication provided between pressure lines 118, 120, 122 and 124 and pressure line 152, unshown pressure line 157, pressure lines 154 and 156, respectively, provided by undercuts 102, 104, 106 and 108, respectively, allow complete control of upper releasing mechanism 234 and lower releasing mechanism 236 even when body assembly 12 is being rotated and reciprocated.

It will be seen, therefore, that the swivel head cementing apparatus with manifold assembly and remote control operation of the present invention is well adapted to carry out the ends and advantages mentioned as well as those inherent therein. While a presently preferred embodiment of the apparatus has been described for the purposes of this disclosure, numerous changes in the arrangement and construction of parts may be made by those skilled in the art. All such changes are encompassed within the scope and spirit of the appended claims.

What is claimed is:

1. A cementing head apparatus comprising:

a body connectable to a tool string;

a cementing manifold connectable to a cement source;

mounting means for rotatably mounting said manifold on said body and providing continuous fluid communication between said manifold and body;

remote control valve means in said cementing manifold for controlling fluid flow from said manifold to said body;

plug means positionable in said body for moving downwardly through the tool string;

pressure actuated releasing means for releasing said plug means so that said plug means may be pumped down said tool string; and connecting means for connecting said releasing means to a pressure supply for providing continuous communication between said pressure supply and said releasing means, said connecting means comprising a swivel connection between said body and manifold.

2. The apparatus of claim 1 wherein said mounting means is characterized by a portion of said swivel connection.

3. The apparatus of claim 1 further comprising another swivel connection on an opposite side of said releasing means from the first mentioned swivel connection.

4. The apparatus of claim 1 wherein:

said swivel connection comprises:

a mandrel extending from said body and defining a pressure passageway therethrough; and a sleeve rotatably disposed around said mandrel and defining a hole therein in fluid communication with said passageway; and further comprising:

a pressure line interconnecting said passageway and said releasing means; and another pressure line in communication with said hole and connectable to said pressure supply.

5. The apparatus of claim 4 further comprising bearing means for rotatably mounting said sleeve on said mandrel.

6. The apparatus of claim 4 further comprising sealing means for sealing between said mandrel and sleeve.

7. The apparatus of claim 4 wherein one of said mandrel and sleeve defines a groove therein adjacent to an end of said passageway and an end of said transverse hole so that said passageway and hole are always in communication regardless of the relative rotational position between said mandrel and sleeve.

8. A cementing head comprising:

a body assembly connectable to a tool string and adapted for receiving a plug therein, said body assembly defining a pressure passageway therein and having first and second mandrel portions;

releasing means engaged with said body assembly for releasing the plug received in said body assembly so that the plug may be pumped down the tool string;

a pressure line interconnecting said passageway and said releasing means;

a first sleeve pivotally engaged with said first mandrel portion and in communication therewith, said first sleeve defining a hole therein in communication with said passageway;

another pressure line in communication with said hole and connectable to a pressure supply;

a second sleeve pivotally engaged with said second mandrel portion and in fluid communication therewith; and a cementing manifold connected to said first and second sleeves and in fluid communication therewith such that said body is rotatable with respect to said manifold while maintaining communication therebetween and while further maintaining communication between said pressure lines.

9. The cementing head of claim 8 wherein:

said first sleeve and said first mandrel portion define an annular first fluid channel therebetween; and said second sleeve and said second mandrel portion define an annular second fluid channel therebetween.

10. The cementing head of claim 9 further comprising sealing means for sealing between said body and said first and second sleeves on opposite sides of each of said first and second fluid channels.

11. The cementing head of claim 8 wherein on of said first mandrel portion and said first sleeve defines an annular channel therein which is in communication with said passageway and said hole.

12. The cementing head of claim 11 further comprising sealing means for sealing between said first mandrel portion and said first sleeve on opposite sides of said annular channel.

13. The cementing head of claim 8 wherein:

said body comprises a pair of body shoulders thereon;

said first and second sleeves comprise first and second sleeve shoulders thereon, each sleeve shoulder facing a corresponding body shoulder; and further comprising a bearing disposed between each pair of facing corresponding shoulders.

14. The cementing head of claim 13 wherein each of said first and second sleeves comprises an additional first and second sleeve shoulder thereon; and further comprising:

a second bearing positioned adjacent to said additional shoulders; and a pair of nuts, each nut being threadingly engaged with said body and adjacent to one of said second bearings, whereby said bearings may be clamped in an operating position.

15. The cementing head of claim 14 further comprising sealing means for sealing between said body and said first and second sleeves on opposite sides of said first and second bearings.

16. The cementing head of claim 8 wherein:

said passageway is one of a plurality of passageways, each passageway having a pressure line connected thereto; and said hole is one of a plurality of holes, each hole being in communication with one of said passageways and having another pressure line connected thereto.

17. The cementing head of claim 16 further comprising sealing means for sealingly separating corresponding sets of passageways and holes.

18. The cementing head of claim 8 wherein said first and second sleeves are on opposite sides of said releasing means.

* * * * *